US011274851B2

(12) United States Patent
Shin et al.

(10) Patent No.: US 11,274,851 B2
(45) Date of Patent: Mar. 15, 2022

(54) AIR CONDITIONING APPARATUS

(71) Applicant: LG Electronics Inc., Seoul (KR)

(72) Inventors: Ilyoong Shin, Seoul (KR); Yongcheol Sa, Seoul (KR); Chiwoo Song, Seoul (KR); Youngjoo Shin, Seoul (KR); Jisung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 121 days.

(21) Appl. No.: 16/792,042

(22) Filed: Feb. 14, 2020

(65) Prior Publication Data

US 2020/0326091 A1 Oct. 15, 2020

(30) Foreign Application Priority Data

Apr. 9, 2019 (KR) ..... 10-2019-0041168

(51) Int. Cl.

| | |
|---|---|
| ***F24F 11/84*** | (2018.01) |
| ***F24F 1/32*** | (2011.01) |
| ***F24F 1/0007*** | (2019.01) |
| ***F24F 13/30*** | (2006.01) |
| *F24F 140/20* | (2018.01) |

(52) U.S. Cl.

CPC ..... *F24F 11/84* (2018.01); *F24F 1/00077* (2019.02); *F24F 1/32* (2013.01); *F24F 13/30* (2013.01); *F24F 2140/20* (2018.01)

(58) Field of Classification Search

CPC .. F24F 11/84; F24F 11/65; F24F 11/67; F24F 2221/54; F24F 1/32; F24F 13/30; F25B 41/20; F25B 2313/0231; F25B 2313/007; F25B 2313/0233; F25B 25/005; F25B 2313/003

See application file for complete search history.

(56) References Cited

U.S. PATENT DOCUMENTS

| | | | | |
|---|---|---|---|---|
| 9,657,955 | B2 * | 5/2017 | Yamashita | F25B 13/00 |
| 2008/0022710 | A1 | 1/2008 | Jeong et al. | |
| 2008/0196432 | A1 | 8/2008 | Shimamoto et al. | |

(Continued)

FOREIGN PATENT DOCUMENTS

| | | |
|---|---|---|
| GB | 2213248 | 8/1989 |
| JP | 2001336858 | 12/2001 |

(Continued)

OTHER PUBLICATIONS

Extended European Search Report in European Appln. No. 20158163.4, dated Aug. 3, 2020, 4 pages.

(Continued)

*Primary Examiner* — Lionel Nouketcha
(74) *Attorney, Agent, or Firm* — Fish & Richardson P.C.

(57) ABSTRACT

An air conditioning apparatus includes: an outdoor unit configured to circulate refrigerant; an indoor unit configured to circulate water; a heat exchange device that connects the indoor unit to the outdoor unit and that is configured to perform heat exchange between the refrigerant and the water; and a plurality of pipes and valves. The heat exchange device includes first and second heat exchangers. The air conditioning apparatus is configured to perform a cooling operation or a heating operation based on operating one or both of the first heat exchanger and the second heat exchanger and one or more of the valves.

13 Claims, 6 Drawing Sheets

(56) References Cited

U.S. PATENT DOCUMENTS

| | | | | |
|---|---|---|---|---|
| 2012/0198873 | A1 | 8/2012 | Yamashita et al. | |
| 2014/0033749 | A1 | 2/2014 | Tamaki et al. | |
| 2015/0300714 | A1* | 10/2015 | Ishimura | F25B 41/26 62/225 |
| 2015/0330673 | A1* | 11/2015 | Honda | F25B 25/005 62/324.1 |

FOREIGN PATENT DOCUMENTS

| | | |
|---|---|---|
| JP | 5279919 | 9/2013 |
| KR | 2016-090178 | 5/2016 |
| KR | 10-2016-0091298 | 8/2016 |
| KR | 10-2019-0024469 | 3/2019 |
| WO | WO2011064830 | 6/2011 |

OTHER PUBLICATIONS

International Search Report in International Appln. No. PCT/KR2019/017838, dated Mar. 26, 2020, 3 pages.

* cited by examiner

AIR CONDITIONING APPARATUS

CROSS-REFERENCE TO RELATED APPLICATIONS

The present application claims priority under 35 U.S.C. 119 and 35 U.S.C. 365 to Korean Patent Application No. 10-2019-0041168, filed on Apr. 9, 2019, which is hereby incorporated by reference in its entirety.

TECHNICAL FIELD

The present disclosure relates to an air conditioning apparatus.

BACKGROUND

Air conditioning apparatuses may maintain air in a certain space to be a proper state according to the use and purpose thereof. In some examples, an air conditioning apparatus may include a compressor, a condenser, an expansion device, and evaporator. The air conditioning apparatus may run a refrigerant cycle including compression, condensation, expansion, and evaporation processes with refrigerant to cool or heat the space.

The air conditioning apparatus may be used in various places. For example, the air conditioning apparatus may be used in a home or an office.

In some cases, when the air conditioning apparatus performs a cooling operation, an outdoor heat exchanger provided in an outdoor unit may serve as a condenser, and an indoor heat exchanger provided in an indoor unit may serve as an evaporator. In some cases, when the air conditioning apparatus performs a heating operation, the indoor heat exchanger may serve as the condenser, and the outdoor heat exchanger may serve as the evaporator.

Recently, the type and amount of refrigerant used in the air conditioning apparatus may be limited according to environmental regulations.

In some cases, a technique for performing cooling or heating by performing heat-exchange between a refrigerant and a predetermined fluid may be used to reduce an amount of used refrigerant. For example, the predetermined fluid may include water.

In some examples, the air conditioning apparatus may include an outdoor unit, a heat medium converter, and an indoor unit.

The heat medium converter may include a heat exchanger, a fastening device disposed at an upstream side of the heat exchanger, and a refrigerant flow path changing device disposed at a downstream side of the heat exchanger.

The refrigerant flow path changing device may be connected to a refrigerant pipe through which a refrigerant that is in a low-temperature state flows during the cooling operation.

In some cases, when portion of a plurality of heat exchangers is used in the cooling operation, if leakage of the refrigerant is prevented by the fastening device disposed at the upstream side of the heat exchanger that is not used, the refrigerant may flow along the refrigerant pipe to generate a refrigerant flow in the heat exchanger. In this case, water may be frozen in a flow path of the heat exchanger, through which the water flows.

SUMMARY

The present disclosure describes an air conditioning apparatus in which water is prevented from being frozen in a water flow path of a heat exchanger even though a refrigerant leaks to an unused heat exchanger when a portion of the plurality of heat exchangers is used during a cooling operation.

The present disclosure also describes an air conditioning apparatus in which a leaking refrigerant is collected from an unused heat exchanger when the refrigerant leaks to the unused heat exchanger.

According to one aspect of the subject matter described in this application, an air conditioning apparatus includes: an outdoor unit configured to circulate refrigerant; an indoor unit configured to circulate water; a heat exchange device that connects the indoor unit to the outdoor unit and that is configured to perform heat exchange between the refrigerant and the water; and a first connection pipe, a second connection pipe, and a third connection pipe that connect the outdoor unit to the heat exchange device. The heat exchange device includes: a first heat exchanger and a second heat exchanger; a first branch pipe and a second branch pipe that are branched from the first connection pipe; first valves disposed at the first branch pipe and the second branch pipe, respectively; a third branch pipe and a fourth branch pipe that are branched from the second connection pipe; second valves disposed at the third branch pipe and the fourth branch pipe, respectively; a first refrigerant pipe and a second refrigerant pipe that are branched from the third connection pipe; a first expansion valve disposed at the first refrigerant pipe; and a second expansion valve disposed at the second refrigerant pipe. The air conditioning apparatus is configured to perform a cooling operation based on the first heat exchanger being operated and the second heat exchanger not being operated in a state in which the first valves are closed, the second valve disposed at the third branch pipe is opened, the second valve disposed at the fourth branch pipe is closed, the first expansion valve is opened, and the second expansion valve is closed.

Implementations according to this aspect may include one or more of the following features. For example, the heat exchange device may further include: a first common gas pipe to which the first branch pipe and the third branch pipe are connected; a first bypass pipe that connects the third branch pipe to the first common gas pipe; a first bypass valve disposed at the first bypass pipe; a second common gas pipe to which the second branch pipe and the fourth branch pipe are connected; a second bypass pipe that connects the fourth branch pipe to the second common gas pipe; and a second bypass valve disposed at the second bypass pipe.

In some examples, the first common gas pipe may be connected to the first heat exchanger, and the second common gas pipe may be connected to the second heat exchanger. The first refrigerant pipe may be connected to the first heat exchanger, and the second refrigerant pipe may be connected to the second heat exchanger. In some examples, each of the first bypass valve and the second bypass valve may be configured to adjust a flow rate of the refrigerant. In some examples, each of the first bypass valve and the second bypass valve may be configured to remain closed based on the cooling operation of the air conditioning apparatus being started.

In some implementations, each of the first heat exchanger and the second heat exchanger may include: a refrigerant flow path configured to guide the refrigerant; and a water flow path configured to guide the water to be heat-exchanged with the refrigerant in the refrigerant flow path. The indoor unit may be configured to receive the water through the water flow path.

In some implementations, the air conditioning apparatus may further include: a temperature sensor configured to sense a temperature of refrigerant in the refrigerant flow path of the second heat exchanger, and a pump configured to operate to supply the water to the water flow path of the second heat exchanger based on the temperature of refrigerant sensed by the temperature sensor being less than a reference temperature. In some examples, the pump may be configured to: stop operating based on an elapse of a predetermined time; or intermittently turn on and turn off.

In some implementations, the second bypass valve may be configured to, based on the refrigerant being accumulated in the refrigerant flow path of the second heat exchanger, be opened in a state in which the first bypass valve is closed. In some examples, the second bypass valve may be configured to intermittently operate to thereby open and close the second bypass pipe a plurality of times. In some examples, the second bypass valve may be configured to operate at predetermined time intervals from a time point at which the second heat exchanger is not operated.

In some implementations, the air conditioning apparatus may be configured to perform the cooling operation based on both of the first heat exchanger and the second heat exchanger being operated in a state in which the first valves are closed, the second valves are opened, the first expansion valve and the second expansion valve are opened, and the first bypass valve and the second bypass valve are closed.

In some implementations, the air conditioning apparatus may be configured to perform a heating operation in a state in which the first valves are opened, the second valves are closed, the first expansion valve and the second expansion valve are opened, and the first bypass valve and the second bypass valve are closed.

According to another aspect, an air conditioning apparatus includes: an outdoor unit configured to circulate refrigerant; a plurality of indoor units configured to circulate water; and a heat exchange device that connects the outdoor unit to the plurality of indoor units and that is configured to perform heat exchange between the refrigerant and the water. The heat exchange device includes: a plurality of heat exchangers, each of the plurality of heat exchangers including a refrigerant flow path and a water flow path; a plurality of expansion valves configured to expand the refrigerant to be introduced into each of the plurality of heat exchangers during a cooling operation, where a first heat exchanger among the plurality of heat exchangers is configured to, in the cooling operation, be operated while a second heat exchanger among the plurality of heat exchangers is not operated; and a refrigerant collection part configured to collect the refrigerant accumulated in the second heat exchanger into the outdoor unit.

Implementations according to this aspect may include one or more of the following features. For example, the heat exchange device may include: a high-pressure pipe configured to guide a high-pressure refrigerant; a first valve disposed at the high-pressure pipe; a low-pressure pipe configured to guide a low-pressure refrigerant; and a second valve disposed at the low-pressure pipe. The refrigerant collection part may include: a bypass pipe connected to the low-pressure pipe and configured to guide the refrigerant by bypassing the second valve disposed at the low-pressure pipe; and a bypass valve disposed at the bypass pipe.

In some implementations, the second valve corresponding to the second heat exchanger may be configured to remain closed in the cooling operation. In some examples, the bypass valve may be configured to, in a state in which the second valve is closed, be opened to collect the refrigerant accumulated in the second heat exchanger into the outdoor unit. In some examples, the bypass valve may be configured to intermittently operate to thereby open and close the bypass pipe a plurality of times. In some implementations, the bypass valve may be configured to operate at predetermined time intervals from a time point at which the second heat exchanger is not operated.

In some implementations, the air conditioning apparatus may be configured to operate one or more heat exchangers among the plurality of heat exchangers while the other of the plurality of heat exchangers are not operated.

The details of one or more implementations are set forth in the accompanying drawings and the description below. Other features will be apparent from the description and drawings, and from the claims.

DETAILED DESCRIPTION

Figure 1:
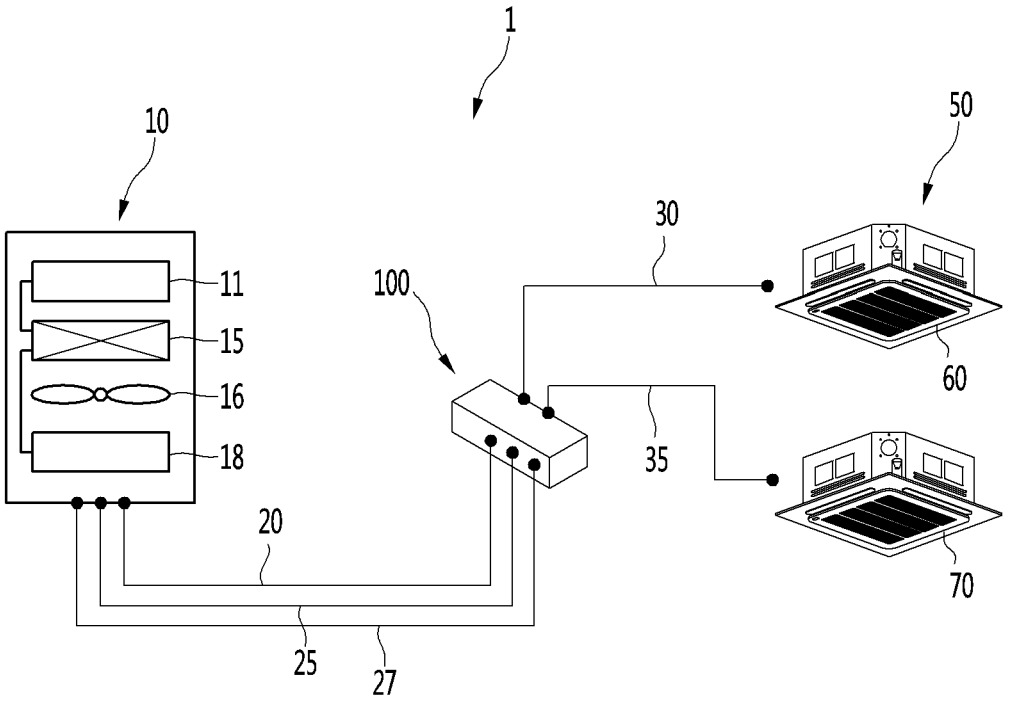
FIG. 1 is a schematic view illustrating an example configuration of an air conditioning apparatus.

Hereinafter, one or more implementations of the present disclosure will be described in detail with reference to the accompanying drawings. Exemplary implementations of the present disclosure will be described below in more detail with reference to the accompanying drawings. It is noted that the same or similar components in the drawings are designated by the same reference numerals as far as possible even if they are shown in different drawings. Further, in description of implementations of the present disclosure, when it is determined that detailed descriptions of well-known configurations or functions disturb understanding of the implementations of the present disclosure, the detailed descriptions will be omitted.

Figure 2:
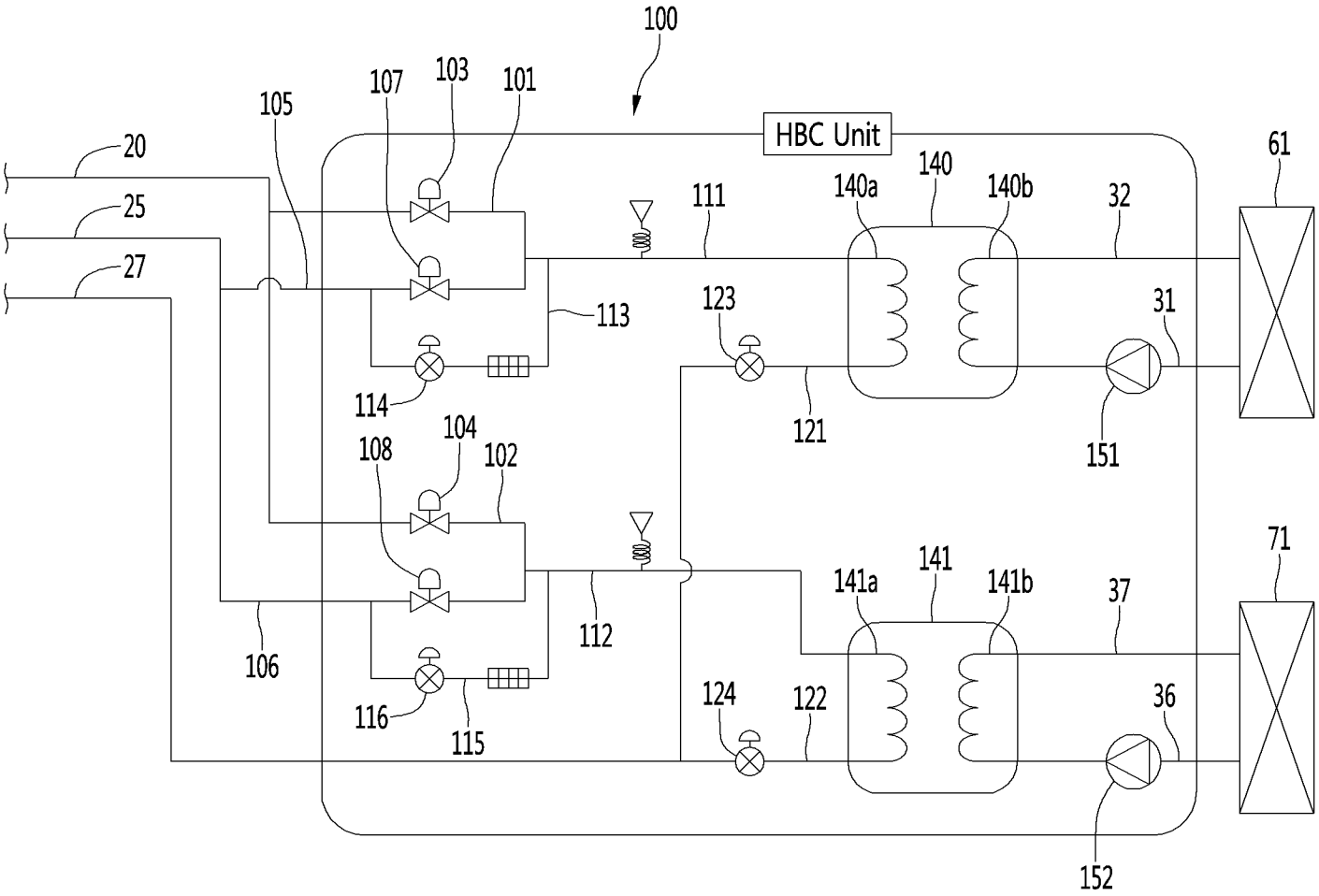
FIG. 2 is a cycle diagram illustrating the configuration of the air conditioning apparatus.

FIG. 1 is a schematic view illustrating an example configuration of an air conditioning apparatus, and FIG. 2 is a cycle diagram illustrating the configuration of the air conditioning apparatus.

Referring to FIGS. 1 and 2, an air conditioning apparatus 1 is connected to an outdoor unit 10, an indoor unit 50, and a heat exchange device connected to the outdoor unit 10 and the indoor unit 50.

The outdoor unit 10 and the heat exchange device 100 may be fluidly connected to each other and circulate a first fluid. For example, the first fluid may include a refrigerant.

For example, the refrigerant may flow through a refrigerant flow path of a heat exchanger, which is provided in the heat exchange device 100, and the outdoor unit 10.

In some implementations, the outdoor unit 10 may include a compressor 11 and an outdoor heat exchanger 15.

An outdoor fan 16 may be provided at one side of the outdoor heat exchanger 15 to blow external air toward the outdoor heat exchanger 15 so that heat exchange between the external air and the refrigerant of the outdoor heat exchanger 15 is performed. The outdoor unit 10 may further include a main expansion valve 18. In some examples, the main expansion valve may include an electronic expansion valve (EEV) that is configured to be controlled by a controller including an electric circuit.

The air conditioning apparatus 1 may further include connection pipes 20, 25, and 27 connecting the outdoor unit 10 to the heat exchange device 100.

The connection pipes 20, 25, and 27 may include a first connection pipe 20 as a gas pipe (a high-pressure gas pipe) through which a high-pressure gas refrigerant flows, a second connection pipe 25 as a gas pipe (a low-pressure gas pipe) through which a low-pressure gas refrigerant flows, and a third connection pipe 27 as a liquid pipe through which a liquid refrigerant flows. For instance, a gas pressure in the first connection pipe 20 may be greater than a gas pressure in the second connection pipe 25.

That is, the outdoor unit 10 and the heat exchange device 100 may have a "three pipe connection structure", and the refrigerant may be circulated through the outdoor unit 10 and the heat exchange device 100 by the three connection pipes 20, 25, and 27.

The heat exchange device 100 and the indoor unit 50 may be fluidly connected by a second fluid. For example, the second fluid may include water.

The water may flow through a water flow path of a heat exchanger, which is provided in the heat exchange device 100, and the outdoor unit 10.

The heat exchange device 100 may include a plurality of heat exchangers 140 and 141. Each of the heat exchangers 140 and 141 may include, for example, a plate heat exchanger. In some examples, the heat exchange device 100 may include more than two heat exchangers. In some cases, the air conditioning apparatus may be configured to operate one or more heat exchangers among the plurality of heat exchangers while the other of the plurality of heat exchangers are not operated. In some cases, the air conditioning apparatus may operate all of the plurality of heat exchangers.

In some implementations, the indoor unit 50 may include a plurality of indoor units 60 and 70. The number of plurality of indoor units 60 and 70 is not limited. In FIG. 1, for example, two indoor units 60 and 70 are connected to the heat exchange device 100.

The plurality of indoor units 60 and 70 may include a first indoor unit 60 and a second indoor unit 70.

The air conditioning apparatus 1 may further include pipes 30 and 35 connecting the heat exchange device 100 to the indoor unit 50.

The pipes 30 and 35 may include a first indoor unit connection pipe 30 and a second indoor unit connection pipe 35, which connect the heat exchange device 100 to each of indoor units 60 and 70.

The water may circulate through the heat exchange device 100 and the indoor unit 50 via the indoor unit connection pipes 30 and 35.

In some examples, as the number of indoor units increases, the number of pipes connecting the heat exchange device 100*a* to the indoor units may also increase.

According to the above-described configuration, the refrigerant circulating through the outdoor unit 10 and the heat exchange device 100 and the water circulating through the heat exchange device 100 and the indoor unit 50 are heat-exchanged with each other through the heat exchangers 140 and 141 provided in the heat exchange device 100.

The water cooled or heated through the heat exchange may be heat-exchanged with the indoor heat exchangers 61 and 71 to perform cooling or heating in the indoor space.

The plurality of heat exchangers 140 and 141 may be provided in the same number as the number of plurality of indoor units 60 and 70. In some implementations, two or more indoor units may be connected to one heat exchanger.

Hereinafter, the heat exchange device 100 will be described in detail.

The heat exchange device 100 may include a first heat exchanger 140 and a second heat exchanger 141, which are fluidly connected to the indoor units 60 and 70, respectively.

The first heat exchanger 140 and the second heat exchanger 141 may have the same structure.

Each of the heat exchangers 140 and 141 may include a plate heat exchanger as an example, and the water flow path and the refrigerant flow path may be alternately stacked.

Each of the heat exchangers 140 and 141 may include refrigerant flow paths 140*a* and 141*a* and water flow paths 140*b* and 141*b*.

The refrigerant flow paths 140*a* and 141*a* may be fluidly connected to the outdoor unit 10, and the refrigerant discharged from the outdoor unit 10 may be introduced into the refrigerant flow paths 140*a* and 141*a*, and then the refrigerant passing through the refrigerant flow paths 140*a* and 141*a* may be introduced into the outdoor unit 10.

Each of the water flow paths 140*b* and 141*b* may be connected to each of the indoor units 60 and 70, and the water discharged from each of the indoor units 60 and 70 may be introduced into the water flow paths 140*b* and 141*b*, and then the water passing through the water flow path 140*b* may be introduced into each of the indoor units 60 and 70.

The heat exchange device 100 may include a first branch pipe 101 and a second branch pipe 102, which are branched from the first connection pipe 20.

For example, a high-pressure refrigerant may flow through the first branch pipe 101 and the second branch pipe 102. Therefore, the first branch pipe 101 and the second branch pipe 102 may be referred to as high-pressure pipes.

The first branch pipes 101 and the second branch pipes 102 may be provided with first valves 103 and 104, respectively. However, the number of branch pipes branched from the first connection pipe 20 is not limited.

The heat exchange device 100 may include a third branch pipe 105 and a fourth branch pipe 106, which are branched from the second connection pipe 25.

For example, a low-pressure refrigerant may flow through the third branch pipe 105 and the fourth branch pipe 106. Therefore, the third branch pipe 105 and the fourth branch pipe 106 may be referred to as, for example, low-pressure pipes.

The third branch pipe 105 and the fourth branch pipe 106 may be provided with second valves 107 and 108, respectively. However, the number of branch pipes branched from the second connection pipe 25 is not limited.

The heat exchange device 100 includes a first common gas pipe 111 to which the first branch pipe 101 and the third branch pipe 105 are connected and a second common gas pipe 112 to which the second branch pipe 102 and the fourth branch pipe are connected.

The first common gas pipe 111 may be connected to one end of the refrigerant flow path 140*a* of the first heat exchanger 140.

The refrigerant pipes 121 and 122 may be connected to the other ends of the refrigerant flow paths 140*a* and 141*a* of the heat exchangers 140 and 141, respectively.

The first refrigerant pipe 121 may be connected to the first heat exchanger 140, and the second refrigerant pipe 122 may be connected to the second heat exchanger 141.

A first expansion valve 123 may be provided in the first refrigerant pipe 121, and a second expansion valve 124 may be provided in the second refrigerant pipe 122.

The first refrigerant pipe 121 and the second refrigerant pipe 122 may be connected to the third connection pipe 27.

Each of the expansion valves 123 and 124 may include, for example, an electronic expansion valve (EEV).

The EEV may adjust a degree of opening thereof to allow a pressure of the refrigerant passing through the expansion valve to drop down. For example, when the expansion valve is fully opened, the refrigerant may pass through the expansion valve without dropping down, and when the degree of opening of the expansion valve decreases, the refrigerant may be decompressed. A degree of decompression of the refrigerant may increase as the degree of opening decreases.

The heat exchange device 100 may further include a first bypass pipe 113 connecting the third branch pipe 105 to the first common gas pipe 111.

The first bypass pipe 113 allows the refrigerant to bypass the second valve 107 of the third branch pipe 105. A first control valve 114 may be provided in the first bypass pipe 113.

In some implementations, the heat exchange device 100 may further include a second bypass pipe 115 connecting the fourth branch pipe 106 to the second common gas pipe 112.

The second bypass pipe 115 allows the refrigerant to bypass the second valve 108 of the fourth branch pipe 106. The second bypass pipe 115 may be provided with a second control valve 116.

The first and second control valves 114 and 116 are valves capable of adjusting a flow rate of the refrigerant. That is, the control valves 114, 116 may be an electronic expansion valve that is capable of adjusting an opening degree. In some examples, the control valve 114 and 116 may be referred to as bypass valves.

The indoor unit connection pipes 30 and 35 may include heat exchanger inlet pipes 31 and 36 and heat exchanger outlet pipes 32 and 37.

Each of the heat exchanger inlet pipes 31 and 36 may be provided with pumps 151 and 152, respectively.

Each of the heat exchanger inlet pipes 31 and 36 and each of the heat exchanger outlet pipes 32 and 37 may be connected to the indoor heat exchanger 61 and 71, respectively.

The heat exchanger inlet pipes 31 and 36 serve as indoor unit inlet pipes with respect to the indoor heat exchangers 61 and 71, and the heat exchanger outlet pipes 32 and 37 serve as the indoor heat exchangers 61 and 71 with respect to the indoor heat exchangers 61 and 71.

Figure 3:
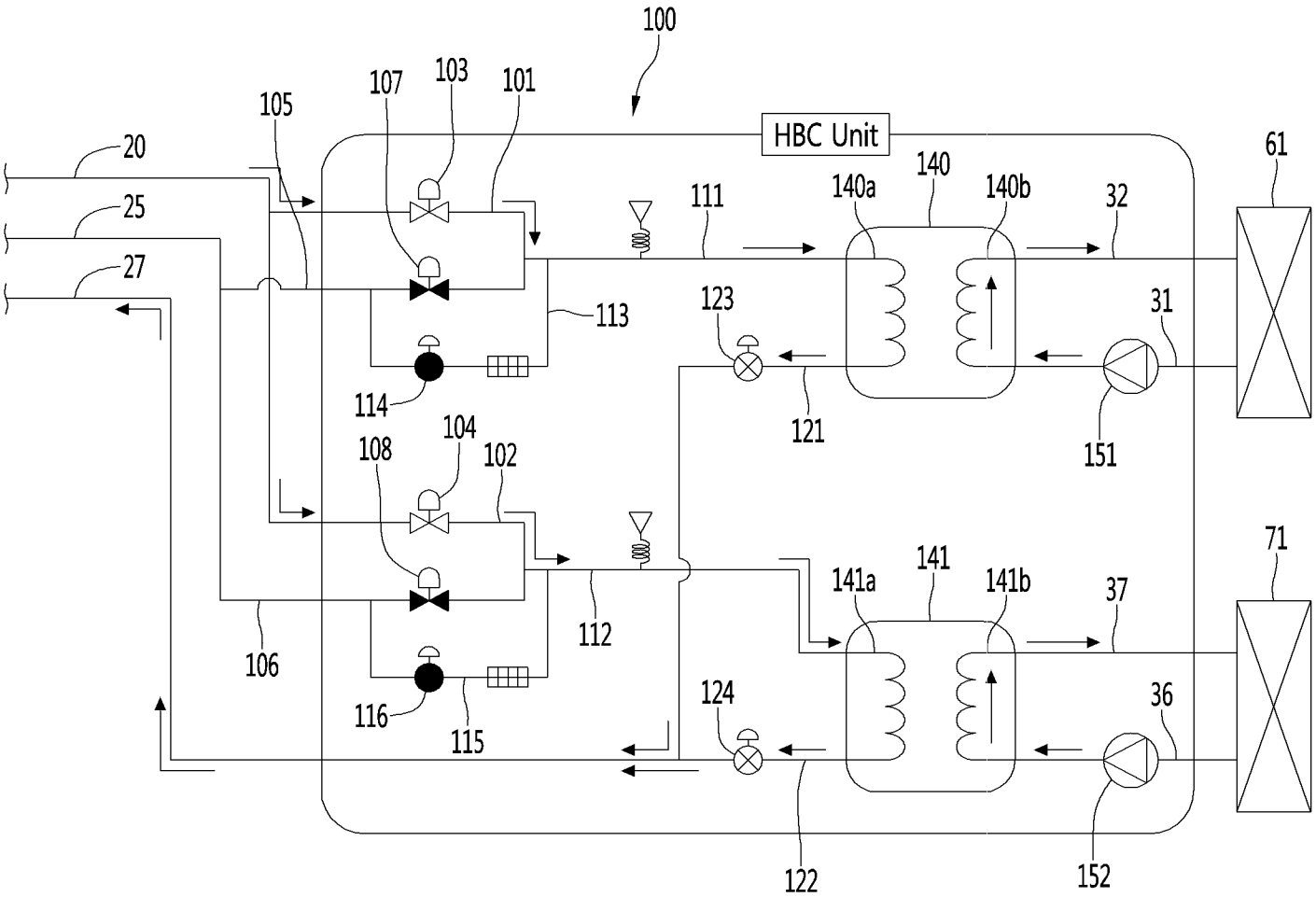
FIG. 3 is a cycle diagram illustrating an example of flows of refrigerant and water in an example heat exchange device during a heating operation of the air conditioning apparatus.

FIG. 3 is a cycle diagram illustrating an example of flows of the refrigerant and the water in the heat exchange device during the heating operation of the air conditioning apparatus.

Referring to FIG. 3, when the air conditioning apparatus 1 performs the heating operation (a plurality of indoor units operate to perform the heating operation), the high-pressure gas refrigerant compressed by the compressor 11 of the outdoor unit 10 may flow to the first connection pipe 20 and then be branched into the first branch pipe 101 and the second branch pipe 102.

When the air conditioning apparatus 1 perform the heating operation, the first valves 103 and 104 of the first and second branch pipes 101 and 102 are opened, and the second valves 107 and 108 of the third and fourth branch pipes 105 and 106 are closed. Also, the first and second bypass valves 114 and 116 are closed.

The refrigerant branched into the first branch pipe 101 flows along the first common gas pipe 111 and then flows into the refrigerant flow path 140*a* of the first heat exchanger 140.

The refrigerant branched into the second branch pipe 102 flows along the second common gas pipe 112 and then flows into the refrigerant flow path 141*a* of the second heat exchanger 141.

In some implementations, when the air conditioning apparatus 1 performs the heating operation, each of the heat exchangers 140 and 141 may serve as a condenser.

When the air conditioning apparatus 1 performs the heating operation, the first expansion valve 123 and the second expansion valve 124 are opened.

The refrigerant passing through the refrigerant flow paths 140*a* and 141*a* of the heat exchangers 140 and 141 flows to the third connection pipe 27 after passing through the expansion valves 123 and 124.

The refrigerant discharged into the third connection pipe 27 may be introduced into the outdoor unit 10 and then be introduced into the compressor 11. The high-pressure refrigerant compressed by the compressor 11 again flows to the heat exchange device 100 through the first connection pipe 20.

The water flowing through the water flow paths 140*b* and 141*b* of the heat exchangers 140 and 141 may be heated by the heat-exchange with the refrigerant, and the heated water may be supplied to each of the indoor heat exchangers 61 and 71 to perform the heating.

Figure 4:
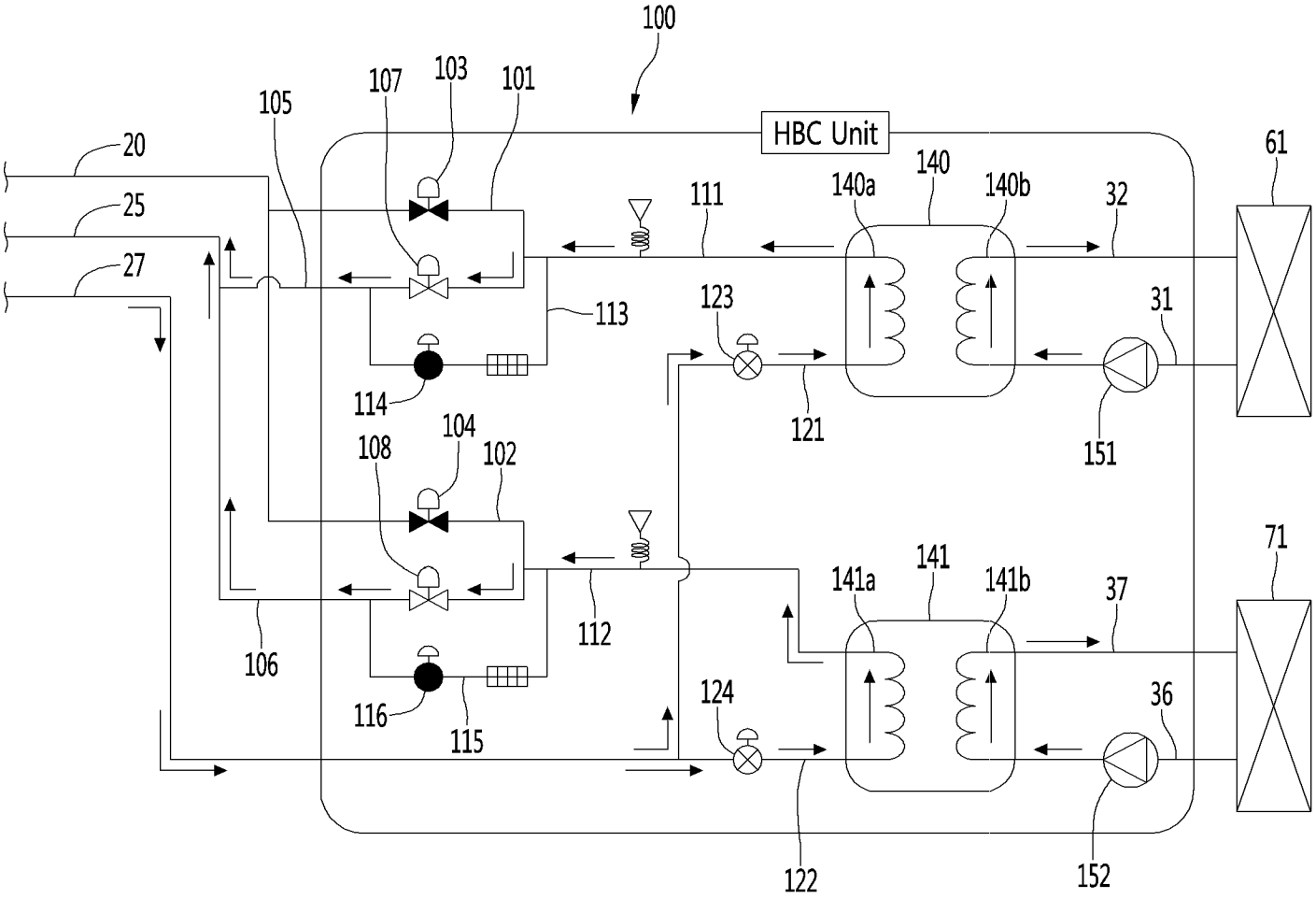
FIG. 4 is a cycle diagram illustrating an example of flows of the refrigerant and the water in the heat exchange device during a cooling operation of the air conditioning apparatus.

FIG. 4 is a cycle diagram illustrating an example of flows of the refrigerant and the water in the heat exchange device during the cooling operation of the air conditioning apparatus.

Referring to FIG. 4, when the air conditioning apparatus 1 performs the cooling operation (the plurality of indoor units operate to perform the cooling operation), a high-pressure liquid refrigerant condensed in the outdoor heat exchanger 15 of the outdoor unit 10 may flow to the third connection pipe 27 and then be distributed into the first refrigerant pipe 121 and the second refrigerant pipe 122.

Since the expansion valves 123 and 124 provided in the first and second refrigerant pipes 121 and 122 are opened to a predetermined degree, the refrigerant may be decompressed into the low-pressure refrigerant while passing through the expansion valves 123 and 124.

The decompressed refrigerant may be heat-exchanged with the water and thus be evaporated while flowing along the refrigerant flow paths 140*a* and 141*a* of the heat exchangers 140 and 141. That is, when the air conditioning apparatus 1 performs the cooling operation, each of the heat exchangers 140 and 141 may serve as an evaporator.

While the air conditioning apparatus 1 performs the cooling operation, the first valves 103 and 104 of the first and second branch pipes 101 and 102 are closed, and the second valves 107 and 108 of the third and fourth branch pipes 105 and 106 are opened. Also, the bypass valves 114 and 116 are closed.

Therefore, the refrigerant passing through the refrigerant flow paths 140*a* and 141*a* of the heat exchangers 140 and 141 flows to each of the common gas pipes 111 and 112.

The refrigerant flowing to each of the common gas pipes 111 and 112 flows into the second connection pipe 25 after flowing through the third and fourth branch pipes 105 and 106.

The refrigerant discharged into the second connection pipe 25 may be introduced into the outdoor unit 10 and then be introduced into the compressor 11. The high-pressure refrigerant compressed by the compressor 11 may be condensed in the outdoor heat exchanger 15, and the condensed liquid refrigerant may again flow along the third connection pipe 27.

Since the flow of the water is the same as that described in FIG. 3, a detailed description thereof will be omitted.

Figure 5:
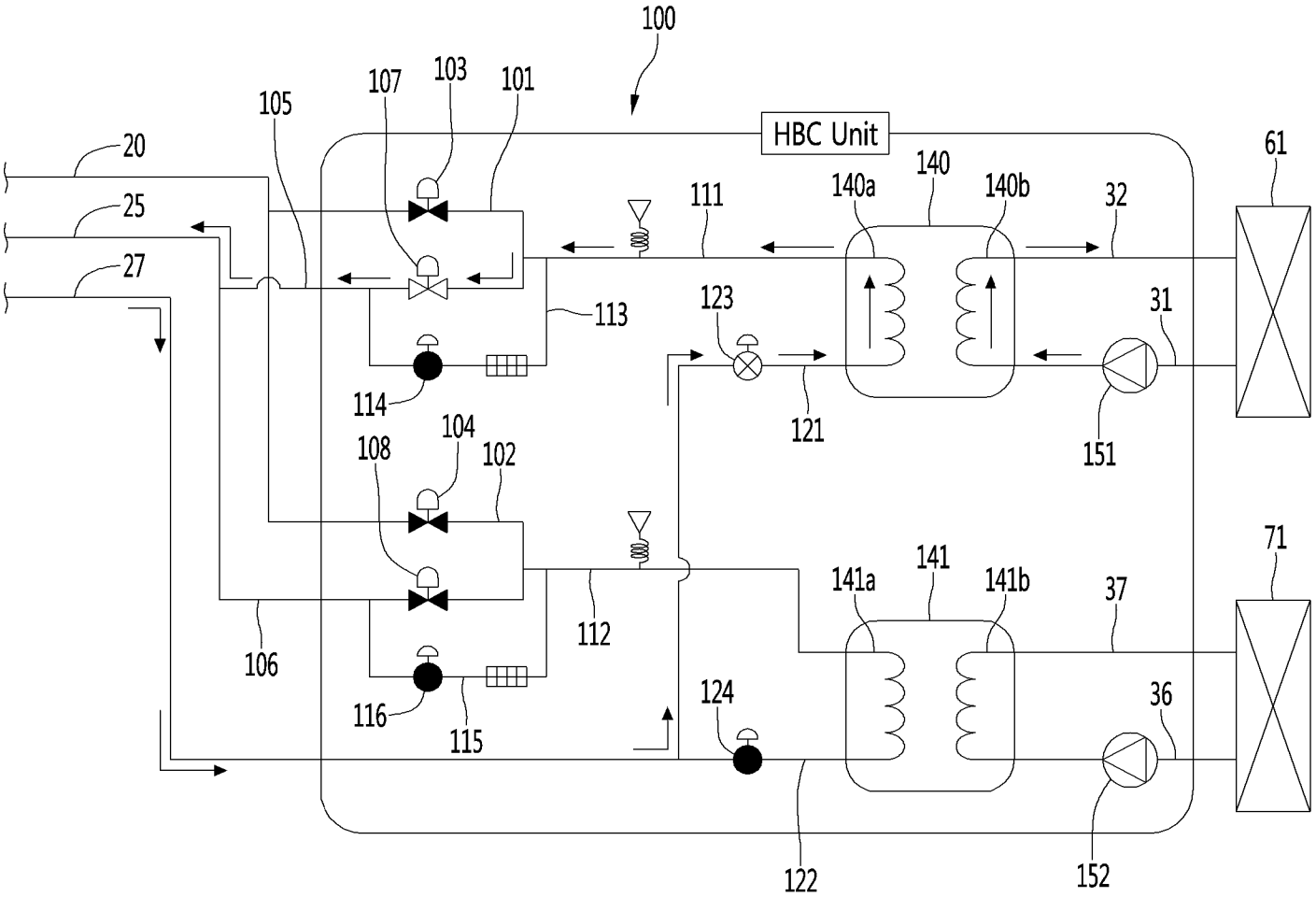
FIG. 5 is a cycle diagram illustrating an example of flows of the refrigerant and the water when only a portion of a plurality of heat exchangers during the cooling operation of the air conditioning apparatus.
Figure 6:
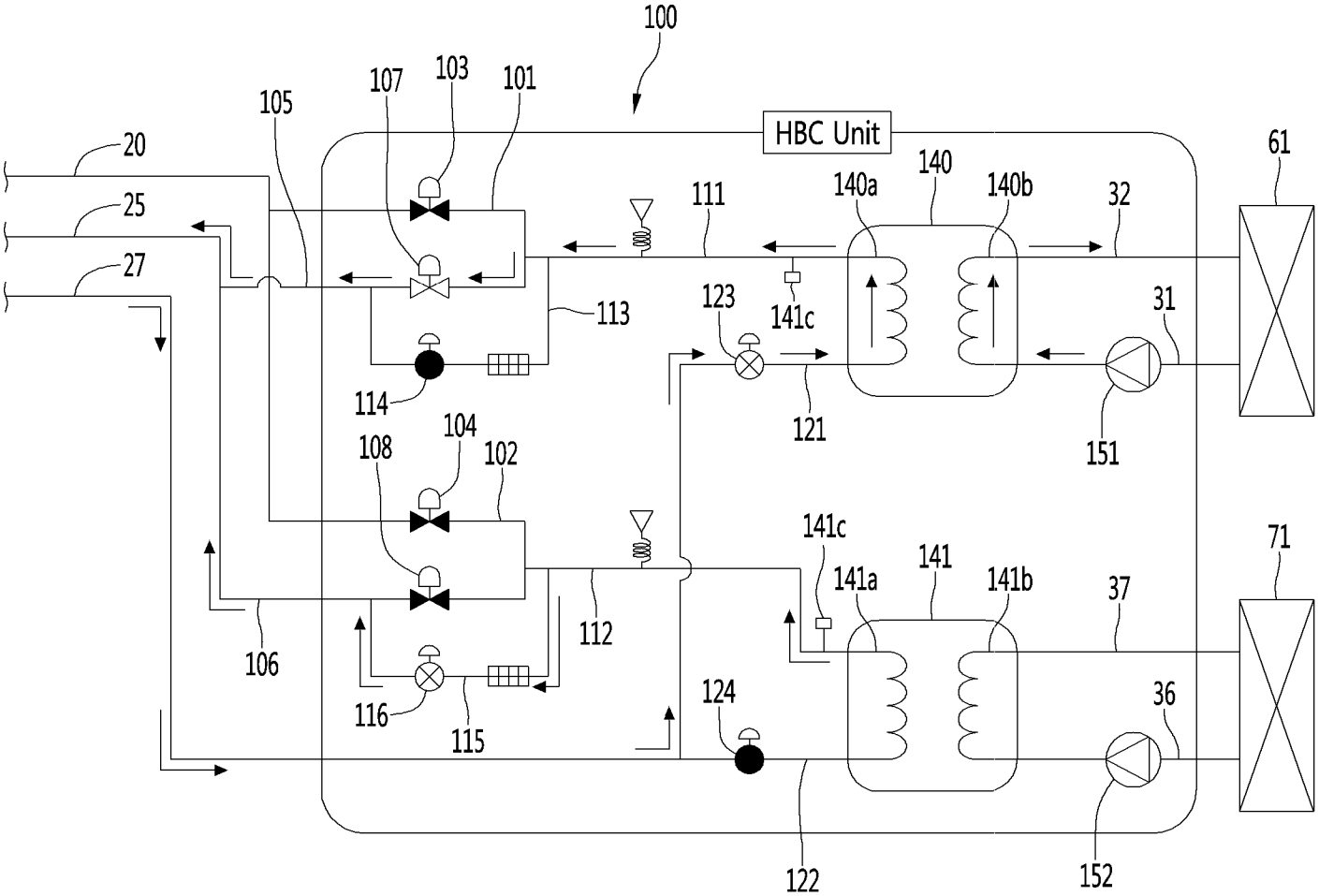
FIG. 6 is a cycle diagram illustrating an example state in which the refrigerant is collected from an unused heat exchanger.

FIG. 5 is a cycle diagram illustrating and example of flows of the refrigerant and the water when only a portion of the plurality of heat exchangers during the cooling operation of the air conditioning apparatus. FIG. 6 is a cycle diagram illustrating an example state in which the refrigerant is collected from an unused heat exchanger.

Referring to FIG. 5, when the number of indoor units, in which the cooling operation is performed, is small, or a cooling load of the indoor units is small, only a portion of the plurality of heat exchangers may be used as the evaporator.

In FIG. 5, the first heat exchanger 140 is used, and the second heat exchanger 141 is not used. The following description may be equally applicable to a case in which the second heat exchanger 141 is used, and the first heat exchanger 140 is not used.

When the air conditioning apparatus 1 performs the cooling operation, the high-pressure liquid refrigerant condensed in the outdoor heat exchanger 15 of the outdoor unit 10 may flow through the third connection pipe 27 and then be distributed into the first refrigerant pipe 121 and the second refrigerant pipe 122.

Here, the first expansion valve 123 corresponding to the used first heat exchanger 140 is opened, and the second expansion valve 124 corresponding to the unused second heat exchanger 141 is closed.

Also, the valve 107 of the third branch pipe 105 corresponding to the used first heat exchanger 140 is opened, and the valve of the fourth branch pipe 106 corresponding to the unused fourth heat exchanger 141 is closed.

Also, when the air conditioning apparatus 1 starts the cooling operation, the bypass valves 114 and 116 are in a closed state.

As a result, since the refrigerant is capable of flowing through the first refrigerant pipe 121, the refrigerant flows through the first expansion valve 123 after being expanded while passing through the first heat exchanger 140. The refrigerant flowing through the first heat exchanger 140 flows to the first common gas pipe 111.

The refrigerant flowing to the first common gas pipe 111 flows to the second connection pipe 25 after flowing through the third branch pipe 105.

The refrigerant discharged into the second connection pipe 25 may be introduced into the outdoor unit 10 and then be introduced into the compressor 11. The high-pressure refrigerant compressed by the compressor 11 may be condensed in the outdoor heat exchanger 15, and the condensed liquid refrigerant may again flow along the third connection pipe 27.

Since the valve 108 of the fourth branch pipe 106 is closed, and the second expansion valve 124 is closed, the refrigerant does not flow in the second heat exchanger 141.

Therefore, even if the water exists in the water flow path 141*b* within the second heat exchanger 141, the second heat exchanger 141 may be prevented from being damaged by the water in the water flow path 141*b*, which is frozen by the refrigerant.

Since the second heat exchanger 141 is not used, the water does not flow to the water flow path 140*b* of the second heat exchanger 141.

Even through the second expansion valve 124 is closed because the second heat exchanger 141 is not used, a small amount of refrigerant may leak from the second expansion valve 124.

The leakage of the refrigerant means that the refrigerant passes through the second expansion valve 124.

If the refrigerant leaks from the second expansion valve 124, the leaking refrigerant is accumulated in the refrigerant flow path 141*a* of the second heat exchanger 141.

When the refrigerant leaks from the second expansion valve 124, an opening degree of the second expansion valve 124 is very small, and thus, when a small amount of refrigerant passes through the second expansion valve 124, a temperature of the refrigerant may significantly decrease.

In the state in which the temperature of the refrigerant significantly decreases as described above, when the refrigerant flows through the second heat exchanger 141, the water existing in the water flow path 141*b* may be more easily frozen when compared to a case in which the refrigerant is stagnated in the second heat exchanger 141.

Like this implementation, when the valve 108 of the fourth branch pipe 106 corresponding to the unused second heat exchanger 141 is closed, the refrigerant does not flow in the refrigerant flow path 141*a* of the second heat exchanger 141 and the second common gas pipe 112.

When the refrigerant leaks from the second expansion valve 124, the temperature of the refrigerant flow path 141*a* of the second heat exchanger 141 decreases. Therefore, a temperature sensor 141*c* may sense an inlet temperature or an outlet temperature of the refrigerant flow path 141*a*.

FIG. 6 illustrates an example in which the temperature sensor 141*c* senses the outlet temperature of the refrigerant flow path 141*a*.

When the temperature sensed by the temperature sensor 141*c* reaches a reference temperature, the second pump 152 may operate so that the water flows through the water flow path 141*b* to prevent the water from being frozen in the water flow path 141*b*.

The second pump 152 may be stopped after operating for a predetermined time or may be intermittently and repeatedly turned on and off.

When the refrigerant leaking from the second expansion valve 124 is continuously accumulated in the second heat exchanger 141, an amount of used refrigerant flowing to the first heat exchanger 140 is reduced. That is, refrigerant cycle performance may be deteriorated due to the lack of the refrigerant.

Therefore, to collect the refrigerant accumulated in the unused heat exchanger into the outdoor unit 10, the bypass valve 116 corresponding to the unused heat exchanger may be intermittently opened.

For example, the second bypass valve 116 corresponding to the unused second heat exchanger 141 may be opened. Here, an opening degree of the second bypass valve 116 may be adjusted to control an amount of refrigerant that is collected into the outdoor unit 10.

The refrigerant that is in an abnormal state may leak into the second heat exchanger 141. When a time for which the refrigerant is stagnated in the second heat exchanger 141 increases, the gas refrigerant may be condensed into the liquid refrigerant. As a result, most of the refrigerant accumulated in the second heat exchanger 141 may be a liquid refrigerant.

When an amount of liquid refrigerant to be collected is large because the opening degree of the second bypass valve 116 is large, the time taken to collect the refrigerant may decrease. However, the low pressure of the compressor may increase by the liquid refrigerant that is suddenly collected, and thus, the cycle performance may be deteriorated.

In some implementations, as illustrated in FIG. 6, the opening degree of the second bypass valve 116 may be adjusted so that a small amount of refrigerant is repeatedly collected several times.

For example, the refrigerant may be collected by the second bypass valve 116 at a predetermined time interval from a time point at which the second heat exchanger 141 is not used.

In some implementations, when it is determined that the collection of the refrigerant is required by determining a state of the refrigerant flowing through the outdoor unit 10 and the heat exchange device 100, the second bypass valve 116 may operate.

When the second bypass valve 116 operates, the refrigerant accumulated in the second heat exchanger 141 flows to the second connection pipe 25 via the second common gas pipe 112 and the second bypass pipe 115.

In some implementations, when a portion of the plurality of heat exchangers is used, since the refrigerant does not flow in the unused heat exchanger even though the refrigerant leaks to the unused heat exchanger, the water in the water flow path of the unused heat exchanger may be prevented from being frozen.

Also, when the refrigerant leaks to the unused heat exchanger, the leaking refrigerant may be collected from the unused heat exchanger to the outdoor unit, and thus the shortage of the refrigerant may be prevented.

In these implementations, the pipe and the valve, through which the refrigerant accumulated in the unused heat exchanger is collected into the outdoor unit, may referred to as a refrigerant collection part. For example, the refrigerant collection part may include the bypass pipe and the bypass valve.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning apparatus comprising:

an outdoor unit configured to circulate refrigerant;

an indoor unit configured to circulate water;

a heat exchange device that connects the indoor unit to the outdoor unit and that is configured to perform heat exchange between the refrigerant and the water; and a first connection pipe, a second connection pipe, and a third connection pipe that connect the outdoor unit to the heat exchange device, wherein the heat exchange device comprises:

a first heat exchanger and a second heat exchanger, a first branch pipe and a second branch pipe that are branched from the first connection pipe, first valves disposed at the first branch pipe and the second branch pipe, respectively, a third branch pipe and a fourth branch pipe that are branched from the second connection pipe, second valves disposed at the third branch pipe and the fourth branch pipe, respectively, a first refrigerant pipe and a second refrigerant pipe that are branched from the third connection pipe, a first expansion valve disposed at the first refrigerant pipe, and a second expansion valve disposed at the second refrigerant pipe, wherein the air conditioning apparatus is configured to perform a cooling operation based on the first heat exchanger being operated and the second heat exchanger not being operated in a state in which the first valves are closed, the second valve disposed at the third branch pipe is opened, the second valve disposed at the fourth branch pipe is closed, the first expansion valve is opened, and the second expansion valve is closed.

2. The air conditioning apparatus of claim 1, wherein the heat exchange device further comprises:

a first common gas pipe to which the first branch pipe and the third branch pipe are connected;

a first bypass pipe that connects the third branch pipe to the first common gas pipe;

a first bypass valve disposed at the first bypass pipe;

a second common gas pipe to which the second branch pipe and the fourth branch pipe are connected;

a second bypass pipe that connects the fourth branch pipe to the second common gas pipe; and a second bypass valve disposed at the second bypass pipe.

3. The air conditioning apparatus of claim 2, wherein:

the first common gas pipe is connected to the first heat exchanger;

the second common gas pipe is connected to the second heat exchanger;

the first refrigerant pipe is connected to the first heat exchanger; and the second refrigerant pipe is connected to the second heat exchanger.

4. The air conditioning apparatus of claim 2, wherein each of the first bypass valve and the second bypass valve is configured to adjust a flow rate of the refrigerant.

5. The air conditioning apparatus of claim 2, wherein each of the first bypass valve and the second bypass valve is configured to remain closed based on the cooling operation of the air conditioning apparatus being started.

6. The air conditioning apparatus of claim 2, wherein each of the first heat exchanger and the second heat exchanger comprises:

a refrigerant flow path configured to guide the refrigerant; and a water flow path configured to guide the water to be heat-exchanged with the refrigerant in the refrigerant flow path, wherein the indoor unit is configured to receive the water through the water flow path.

7. The air conditioning apparatus of claim 6, further comprising:

a temperature sensor configured to sense a temperature of refrigerant in the refrigerant flow path of the second heat exchanger; and a pump configured to operate to supply the water to the water flow path of the second heat exchanger based on the temperature of refrigerant sensed by the temperature sensor being less than a reference temperature.

8. The air conditioning apparatus of claim 7, wherein the pump is configured to:

stop operating based on an elapse of a predetermined time; or intermittently turn on and turn off.

9. The air conditioning apparatus of claim 6, wherein the second bypass valve is configured to, based on the refrigerant being accumulated in the refrigerant flow path of the second heat exchanger, be opened in a state in which the first bypass valve is closed.

10. The air conditioning apparatus of claim 9, wherein the second bypass valve is configured to intermittently operate to thereby open and close the second bypass pipe a plurality of times.

11. The air conditioning apparatus of claim 10, wherein the second bypass valve is configured to operate at predetermined time intervals from a time point at which the second heat exchanger is not operated.

12. The air conditioning apparatus of claim 2, wherein the air conditioning apparatus is configured to perform the cooling operation based on both of the first heat exchanger and the second heat exchanger being operated in a state in which the first valves are closed, the second valves are opened, the first expansion valve and the second expansion valve are opened, and the first bypass valve and the second bypass valve are closed.

13. The air conditioning apparatus of claim 2, wherein the air conditioning apparatus is configured to perform a heating operation in a state in which the first valves are opened, the second valves are closed, the first expansion valve and the second expansion valve are opened, and the first bypass valve and the second bypass valve are closed.

* * * * *